US011687014B2

(12) United States Patent
Nomura

(10) Patent No.: US 11,687,014 B2
(45) Date of Patent: Jun. 27, 2023

(54) IMAGE FORMING APPARATUS

(71) Applicant: CANON KABUSHIKI KAISHA, Tokyo (JP)

(72) Inventor: Yoshihisa Nomura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/733,280

(22) Filed: Apr. 29, 2022

(65) Prior Publication Data

US 2022/0404731 A1 Dec. 22, 2022

(30) Foreign Application Priority Data

Jun. 16, 2021 (JP) ..... 2021-100144

(51) Int. Cl.
*G03G 15/043* (2006.01)
*G03G 15/04* (2006.01)
*G03G 15/00* (2006.01)

(52) U.S. Cl.
CPC ..... *G03G 15/043* (2013.01); *G03G 15/04054* (2013.01); *G03G 15/5029* (2013.01)

(58) Field of Classification Search
CPC ..... G03G 15/043; G03G 15/04054; G03G 15/5008; G03G 15/5029; G03G 2215/00738; G03G 2215/00742
See application file for complete search history.

(56) References Cited

U.S. PATENT DOCUMENTS 4,922,272 A * 5/1990 Wakamatsu ..... G03G 15/5008 347/139
10,126,696 B1 * 11/2018 Kuo ..... G03G 15/043
2016/0282751 A1 * 9/2016 Yano ..... G03G 15/04054
2017/0315466 A1 * 11/2017 Kamikura ..... G03G 15/043

FOREIGN PATENT DOCUMENTS

JP 2015-112856 A 6/2015

* cited by examiner

*Primary Examiner* — Carla J Therrien
(74) *Attorney, Agent, or Firm* — Venable LLP

(57) ABSTRACT

In an image forming apparatus, a CPU can perform in a normal mode and a low mode in which a photoconductive drum rotates at a rate m/n times the rotational rate in the normal mode, and lower than the rotational rate in the normal mode. In the low mode, the CPU causes a synchronizing signal generation portion to generate a line synchronizing signal at a cycle 1/m times the cycle of the line synchronizing signal generated in the normal mode, and causes a chip data conversion portion to transmit, to an exposure head, the same image data signal m times and transmit, to the exposure head, an image data signal that brings a light-emitting portion into no light emission n-m times, in synchronization with n number of line synchronizing signals.

5 Claims, 16 Drawing Sheets

IMAGE FORMING APPARATUS

BACKGROUND OF THE INVENTION

Field of the Invention

The present invention relates to an image forming apparatus including an exposure head.

Description of the Related Art

In image forming with an electrophotographic image forming apparatus, the surface of a photoconductive drum is irradiated with light corresponding to image data, so that an electrostatic latent image is formed on the surface of the photoconductive drum. After that, a developing portion causes toner to adhere to the electrostatic latent image on the surface of the photoconductive drum, to form a toner image. After the toner image is transferred to a sheet, a fixing portion fixes, by heating, the transferred toner image on the sheet to the sheet, so that an image is formed.

A sheet of thick paper is larger in heat capacity than a sheet relatively small in basis weight, such as a sheet of plain paper. Thus, when such a sheet of thick paper is used as a sheet for image forming, a large quantity of heat is required in order to fix a toner image to the sheet. Thus, it has been known that the conveyance rate of a sheet is set to a rate lower than the normal rate to lengthen the period during which a fixing portion heats a toner image supported on a sheet such that a larger quantity of heat is applied to the toner image and the sheet, enabling stable fixing of a toner image to a sheet of thick paper. That is, an image forming apparatus having such an arrangement as above has a normal mode in which a sheet is conveyed at the normal rate and a low mode in which a sheet is conveyed at a rate lower than the rate in the normal mode. Because the rotational rate of a photoconductive drum is related to the conveyance rate of a sheet, the rotational rate of the photoconductive drum is lower in the low mode than in the normal mode.

Japanese Patent Application Laid-Open No. 2015-112856 discloses an image forming apparatus including, as a device that irradiates a photoconductive drum with light to form an electrostatic latent image, an exposure head including a light-emitting portion having an LED or organic EL and a lens that causes light emitted from the light-emitting portion to form an image on the surface of the photoconductive drum. Use of such an exposure head enables reductions in the size and manufacturing cost of an image forming apparatus because the exposure head is less in the number of components than a laser-scanning device that causes laser light to deflection-scan through a rotatable polygonal mirror to form an electrostatic latent image.

An image forming apparatus equipped with an exposure head has a larger quantity of light to be emitted to the region corresponding to one pixel on a photoconductive drum in image forming in such a low mode as described above than in image forming in the normal mode. This is because the rotational rate of the photoconductive drum is lower in the low mode than in the normal mode, namely, the period during which light is emitted to the region corresponding to one pixel on the photoconductive drum is longer in the low mode than in the normal mode. In this case, excessive toner in developing an electrostatic latent image with a developing portion leads to an increase in toner consumption.

SUMMARY OF THE INVENTION

It is desirable to provide an image forming apparatus including an exposure head, enabling, even in image forming in a mode in which the rotational rate of a photoconductive drum is low, inhibition of excessive toner from adhering on the photoconductive drum.

According to a representative configuration of the present invention for achievement of the above, provided is an image forming apparatus including: a photoconductive drum; an exposure head including a plurality of light-emitting portions arranged along in a rotational-axis direction of the photoconductive drum, the plurality of light-emitting portions each being configured to emit light, based on an image data signal, for exposure of the photoconductive drum; a control signal generation portion configured to generate, at a predetermined cycle, a control signal that controls a timing of light emission of each of the plurality of light-emitting portions; an image data signal transmission portion configured to transmit the image data signal to the exposure head, in synchronization with the control signal, for light emission of each of the plurality of light-emitting portions based on the image data signal; and a controller configured to control the control signal generation portion, the image data signal transmission portion, and a rotational rate of the photoconductive drum, wherein the controller is allowed to perform a first mode in which the photoconductive drum rotates at a first rotational rate and a second mode in which the photoconductive drum rotates at a second rotational rate m/n times the first rotational rate, lower than the first rotational rate, and in the second mode, for exposure for forming an image for one line onto a sheet, causes the control signal generation portion to generate the control signal at a cycle 1/m times a cycle of the control signal generated in the first mode, and causes the image data signal transmission portion to transmit, to the exposure head, the same image data signal m times and transmit, to the exposure head, the image data signal that brings the plurality of light-emitting portions into no light emission n-m times, in synchronization with n number of the control signals.

Further features of the present invention will become apparent from the following description of exemplary embodiments with reference to the attached drawings.

DESCRIPTION OF THE EMBODIMENTS

<Image Forming Apparatus>

The entire configuration of an image forming apparatus A according to an embodiment of the present invention will be described below together with the operation at the time of image forming with reference to the drawings. Note that, unless otherwise specified, the dimensions, material, and shape of each of the following constituent components and the relative arrangement thereof should not be construed to limit the scope of the invention.

The image forming apparatus A serves as a full-color image forming apparatus that transfers, to a sheet, respective images of four-color toners of yellow Y, magenta M, cyan C, and black K, to form an image. Note that, in the following description, members that involve the yellow toner are denoted with Y as the suffix, members that involve the magenta toner are denoted with M as the suffix, members that involve the cyan toner are denoted with C as the suffix, and members that involve the black toner are denoted with K as the suffix. However, the configurations and operations of the members are substantially the same except for the colors of toner. Thus, the suffixes thereof will be appropriately omitted when no distinction is required.

Figure 1:
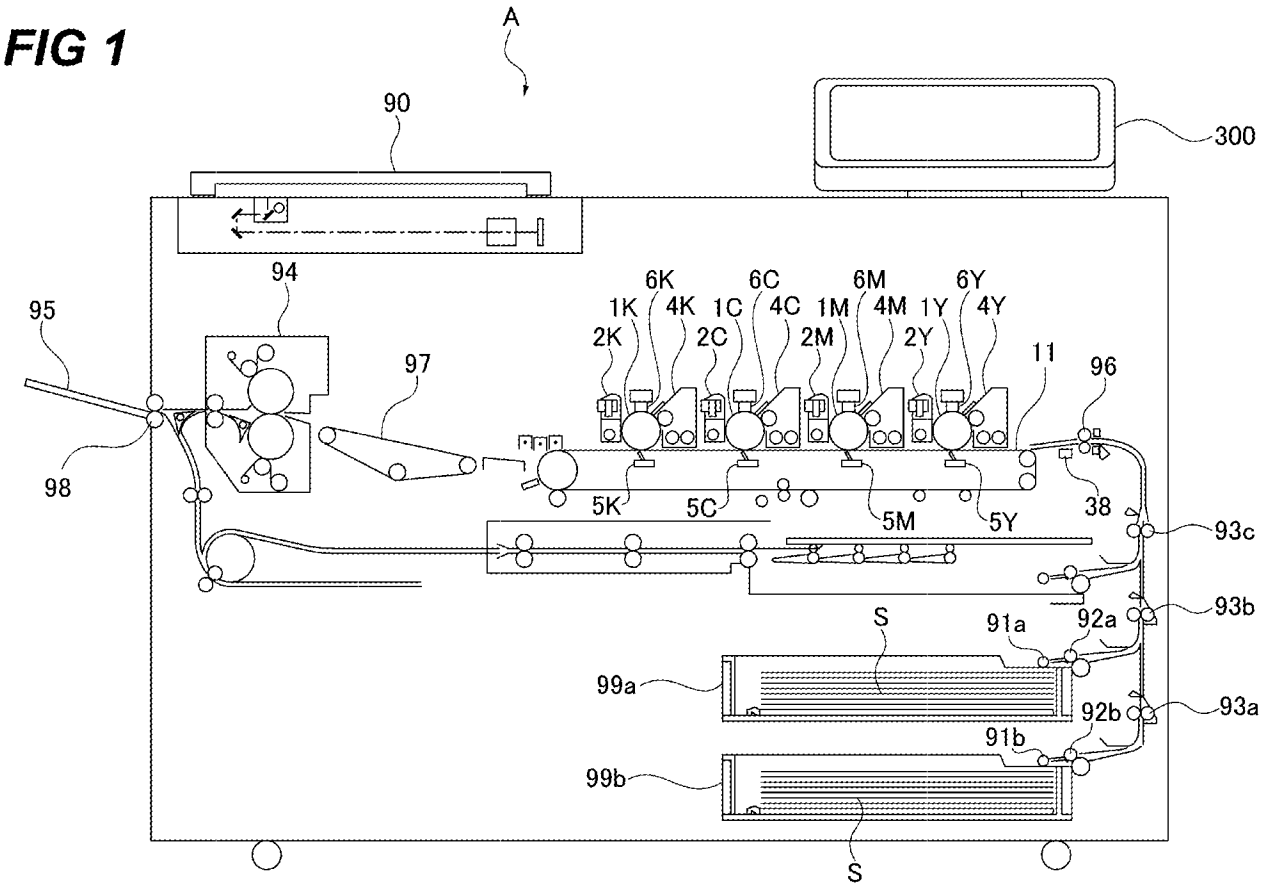
FIG. 1 is a schematic sectional view of an image forming apparatus.

FIG. 1 is a schematic sectional view of the image forming apparatus A. As illustrated in FIG. 1, the image forming apparatus A includes an image forming portion that forms an image. The image forming portion includes photoconductive drums 1 (1Y, 1M, 1C, and 1K), charging devices 2 (2Y, 2M, 2C, and 2K), and exposure heads 6 (6Y, 6M, 6C, and 6K). The image forming portion includes developing devices 4 (4Y, 4M, 4C, and 4K) as a developing portion, transfer devices 5 (5Y, 5M, 5C, and 5K) as a transfer portion, and a conveying belt 11.

The image forming apparatus A includes a touch-panel operation portion 300 (detection portion) that a user operates for various types of setting regarding image forming. For example, the user operates the operation portion 300 to designate the number of sheets for image forming or the size of a sheet for image forming. The user operates the operation portion 300 to input the basis weight of a sheet S housed in a sheet cassette 99*a* or 99*b* (e.g., thick paper, plain paper, or the brand of a sheet). Note that, for example, instead of being input through the operation portion 300, the basis weight of a sheet S may be measured by a sensor 38 (detection portion) disposed in a conveyance path.

As the sensor 38 that measures a basis weight, for example, a transmissive optical sensor can be used. Such a transmissive optical sensor is achieved by a combination of a light-emitting element, such as an LED, and a light-receiving element, such as a photodiode. When a sheet S blocks light emitted from the light-emitting element toward the light-receiving element, a reduction is made in the light quantity that the light-receiving element receives. The light-receiving element converts the received light quantity into a voltage value and functions as a switch with a predetermined threshold set in voltage level.

In general, as the basis weight of a sheet S for image forming increases, its thickness increases. In a case where a sheet S is made of thin paper small in basis weight, light emitted from an LED passes through the sheet S. In a case where a sheet S is made of thick paper large in basis weight, light emitted from the LED hardly passes through the sheet S. Thus, focusing on the relationship between the sensor 38 and the basis weight of a sheet S, the received light quantity of the light-receiving element at the front end or rear end portion of a sheet S that passes through the sensor 38 is measured with the light-emitting element remaining constant in the quantity of light emission, so that the basis weight of a sheet S can be predicted. Because an image tends to be less formed at the front end or rear end of a sheet S than at a portion near the center thereof, use of such an end portion as the position of measurement aims at a rise in the accuracy of measurement.

Figure 8:
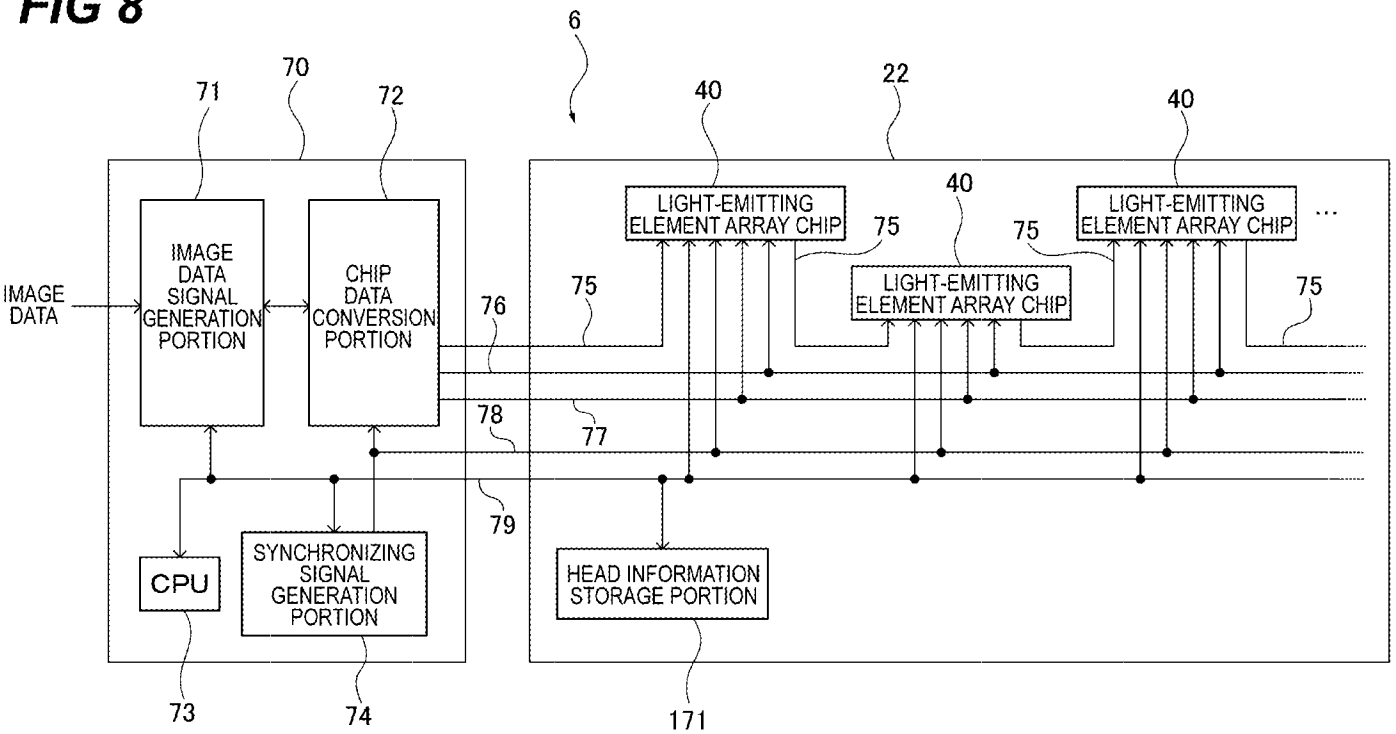
FIG. 8 is a block diagram of the system configuration of an image controller and an exposure head.

The operation portion 300 and the sensor 38 are electrically in connection with a CPU 73 illustrated in FIG. 8. According to the basis weight of a sheet S detected from the operation portion 300 or the sensor 38, the CPU 73 controls the rotational rate of each type of roller that conveys a sheet S, to set the conveyance rate of a sheet S at the time of image forming. The conveyance rate of a sheet S herein is defined as the rate at which a sheet S passes through a fixing device 94 (fixing portion).

For example, the CPU 73 sets, for image forming, the conveyance rate of a sheet S lower in the low mode in which an image is formed on a sheet S made of thick paper having a basis weight not less than a predetermined basis weight than in the normal mode in which an image is formed on a sheet S made of plain paper having a basis weight less than the predetermined basis weight. Because the rotational rate of each photoconductive drum 1 is related to the conveyance rate of a sheet S, the CPU 73 sets the rotational rate of each photoconductive drum 1 lower in the low mode (second mode) than in the normal mode (first mode).

Thus, the period during which the fixing device 94 heats a toner image supported on a sheet S large in basis weight is lengthened such that a larger quantity of heat is applied to the toner image and the sheet S, enabling stable fixing of the toner image to the sheet S large in heat capacity. Note that the timing at which the CPU 73 makes a switch between the low mode and the normal mode is not limited to the above timing. For example, the CPU 73 may set the low mode at the time of image forming higher in quality than normal image forming such that the resolution in the sub-scanning direction identical to the rotation direction of each photoconductive drum 1 is higher in the low mode than in the normal mode.

Next, the image forming operation of the image forming apparatus A will be described. For image forming, a sheet S housed in the sheet cassette 99*a* is sent to a registration roller 96 by a pickup roller 91*a*, a feed roller 92*a*, and conveying rollers 93*b* and 93*c* or a sheet S housed in the sheet cassette 99*b* is sent to the registration roller 96 by a pickup roller 91*b*, a feed roller 92*b*, and a conveying roller 93*a* in addition to the conveying rollers 93*b* and 93*c*. After that, the sheet S is fed to the conveying belt 11 at a predetermined timing by the registration roller 96.

Meanwhile, in the image forming portion, the charging device 2Y charges the surface of the photoconductive drum 1Y Next, according to image data read by an image reading portion 90 or image data transmitted from an external device (not illustrated), the exposure head 6Y irradiates the surface of the photoconductive drum 10Y with light to form an electrostatic latent image on the surface of the photoconductive drum 10Y After that, the developing device 4Y causes yellow toner to adhere to the electrostatic latent image formed on the surface of the photoconductive drum 1Y to form a yellow toner image on the surface of the photoconductive drum 1Y Due to application of a transfer bias to the transfer device 5Y, the toner image formed on the surface of the photoconductive drum 1Y is transferred to the sheet S being conveyed by the conveying belt 11.

Due to similar processes, the exposure heads 6M, 6C, and 6K irradiate, respectively, the photoconductive drums 1M, 1C, and 1K with light, to form electrostatic latent images, and then the developing devices 4M, 4C, and 4K form magenta, cyan, and black toner images, respectively. Then, due to application of a transfer bias to each of the transfer devices 5M, 5C, and 5K, each toner image is transferred so as to be superimposed on the yellow toner image on the sheet S. Thus, a full-color toner image corresponding to the image data is formed on the surface of the sheet S.

After that, the sheet S supporting the toner image is conveyed to the fixing device 94 by a conveying belt 97, and then is subjected to heating and pressing by the fixing device 94. Thus, the toner image on the sheet S is fixed to the sheet S. After that, the sheet S having the toner image fixed thereto is discharged to a discharge tray 95 by a discharge roller 98.

<Exposure Head>

Next, the configuration of an exposure head 6 will be described.

Figure 2A:
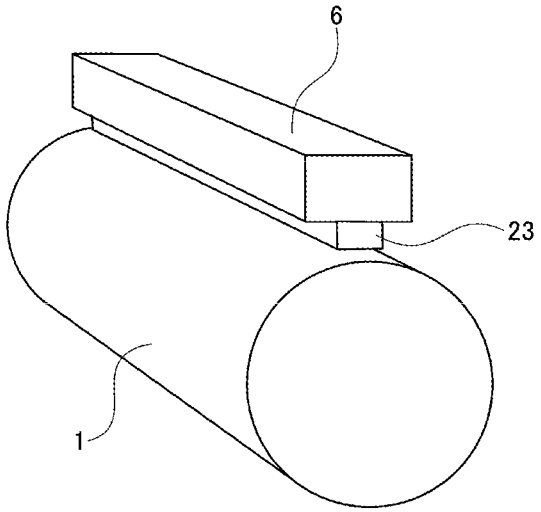
FIGS. 2A and 2B are, respectively, a perspective view and a sectional view of a photoconductive drum and an exposure head.
Figure 2B:
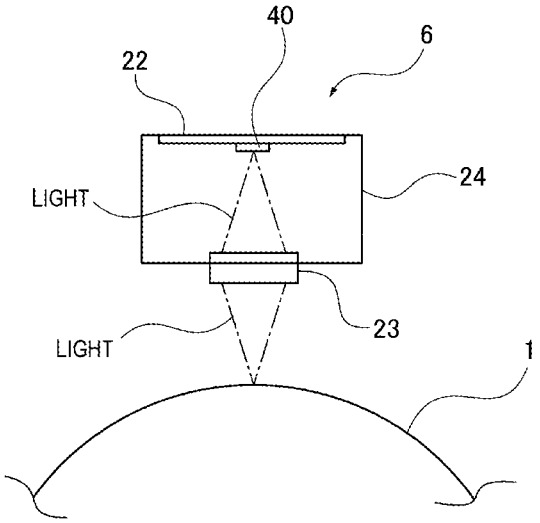
Figure 3A:
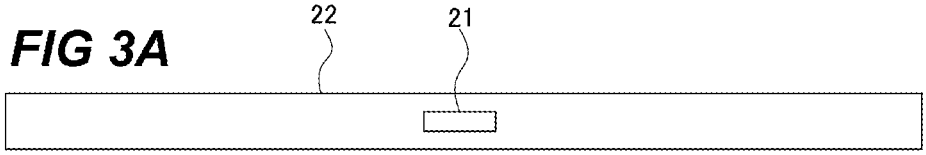
FIGS. 3A, 3B, and 3C each illustrate either mounted face of a printed circuit board included in the exposure head.
Figure 3B:
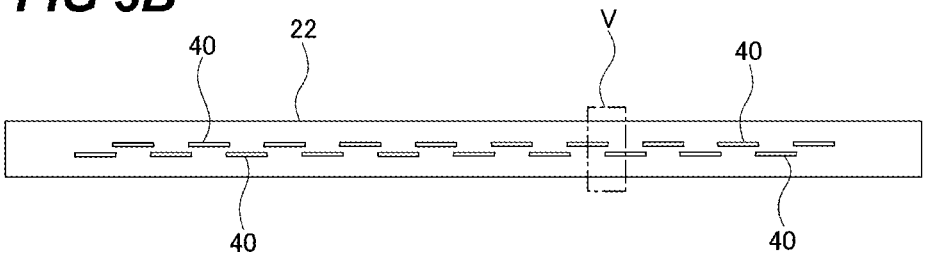
Figure 3C:
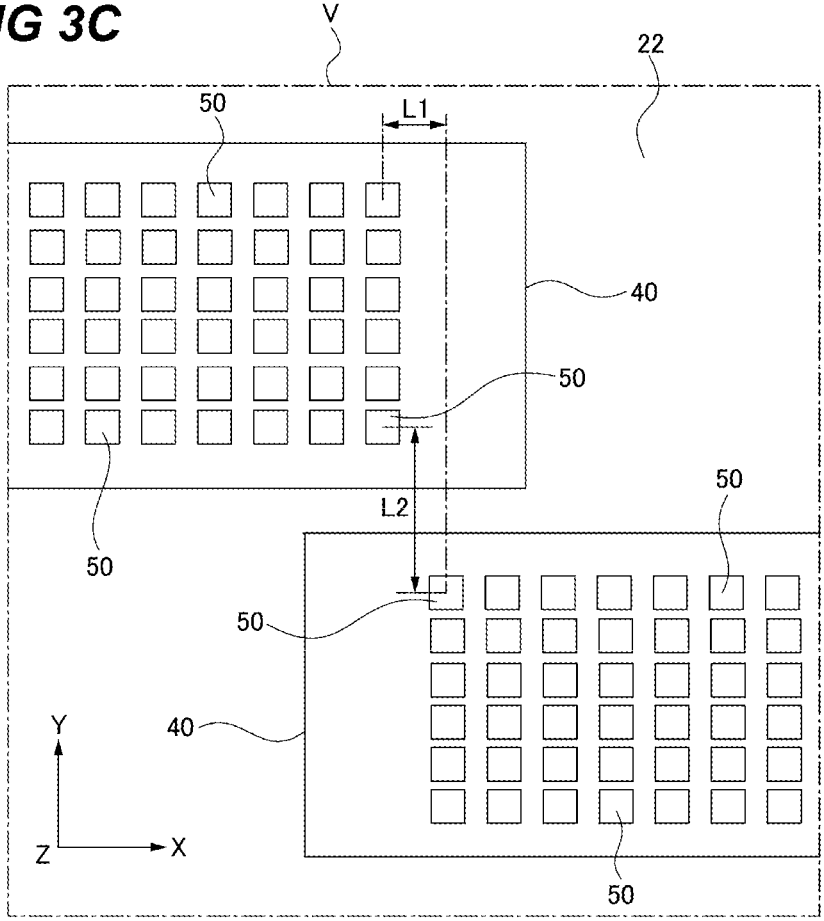

FIG. 2A is a perspective view of a photoconductive drum 1 and an exposure head 6. FIG. 2B is a sectional view of the photoconductive drum 1 and the exposure head 6. FIGS. 3A and 3B illustrate, respectively, one mounted face and the other mounted face of a printed circuit board 22 included in the exposure head 6. FIG. 3C is an enlarged view of a region V illustrated in FIG. 3B.

Referring to FIGS. 2A and 2B, the exposure head 6 is fixed, opposite the surface of the photoconductive drum 1, by a fixing member (not illustrated). The exposure head 6 includes a light-emitting element array chip 40 that emits light, in addition to the printed circuit board 22 on which the light-emitting element array chip 40 is mounted. The exposure head 6 includes a rod lens array 23 that causes light emitted from the light-emitting element array chip 40 to form an image (to focus) on the photoconductive drum 1, and a housing 24 to which the rod lens array 23 and the printed circuit board 22 are fixed.

A connector 21 is mounted on the face opposite to the mounted face on which the printed circuit board 22 has the light-emitting element array chip 40. The connector 21 is provided for transmission of a control signal from an image controller 70 (refer to FIG. 8) to the light-emitting element array chip 40 and for connection of a power-supply line. The light-emitting element array chip 40 is driven through the connector 21.

Referring to FIGS. 3A, 3B, and 3C, 20 light-emitting element array chips 40 are mounted in two rows and in a staggered pattern on the printed circuit board 22. Each light-emitting element array chip 40 includes 748 light-emitting portions 50 arranged at predetermined resolution pitches in its longitudinal direction (X direction). Each light-emitting element array chip 40 includes light-emitting portions 50 arranged at predetermined pitches in its lateral direction (Y direction). That is, each light-emitting element array chip 40 includes light-emitting portions 50 arranged two-dimensionally in the X direction and in the Y direction orthogonal to the X direction.

In the present embodiment, the resolution pitch of each light-emitting element array chip 40 is 1200 dpi (approximately 21.16 m). The distance from one end to the other end in the longitudinal direction of the light-emitting portions 50 included in each light-emitting element array chip 40 is approximately 15.8 mm. That is, the exposure head 6 includes 14960 light-emitting portions 50 in total in the X direction, enabling exposure processing corresponding to an image width of approximately 316 mm (≈approximately 15.8 mm×20 chips) in the longitudinal direction.

The interval L1 between the centers of the light-emitting portions 50 mutually closest in the longitudinal direction between adjacent light-emitting element array chips 40 is approximately 21.16 m. That is, the pitch between each light-emitting portion 50 in the longitudinal direction at the boundary portion between each light-emitting element array chip 40 corresponds to a resolution of 1200 dpi. The interval L2 between the centers of the light-emitting portions 50 mutually closest in the lateral direction (Y direction) between light-emitting element array chips 40 arranged in two rows is approximately 105 μm (corresponds to five pixels in 1200 dpi).

In the present embodiment, the X direction identical to the longitudinal direction of each light-emitting element array chip 40 corresponds to the rotational-axis direction of the photoconductive drum 1, and the Y direction identical to the lateral direction of each light-emitting element array chip 40 corresponds to the rotational direction of the photoconductive drum 1. The Z direction corresponds to the stack direction of the layers in each light-emitting portion 50 having a layered structure to be described below and also corresponds to the direction in which each light-emitting portion 50 emits light. Note that the longitudinal direction of each light-emitting element array chip 40 may have an angle of approximately ±1° with respect to the rotational-axis direction of the photoconductive drum 1. The lateral direction of each light-emitting element array chip 40 may have an angle of approximately ±1° with respect to the rotational direction of the photoconductive drum 1.

<Light-Emitting Element Array Chip>

Next, the configuration of a light-emitting element array chip 40 will be described.

Figure 4:
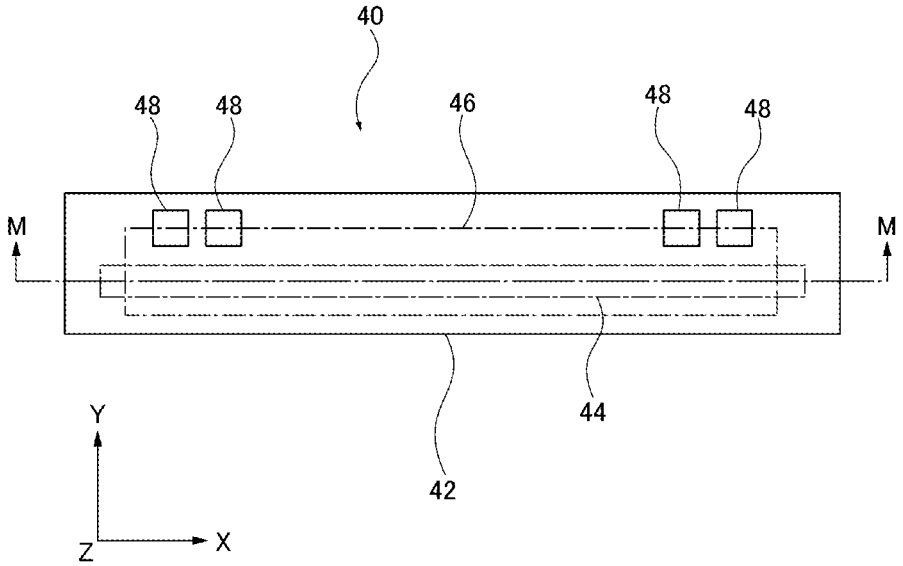
FIG. 4 is a schematic view of a light-emitting element array chip.
Figure 5:
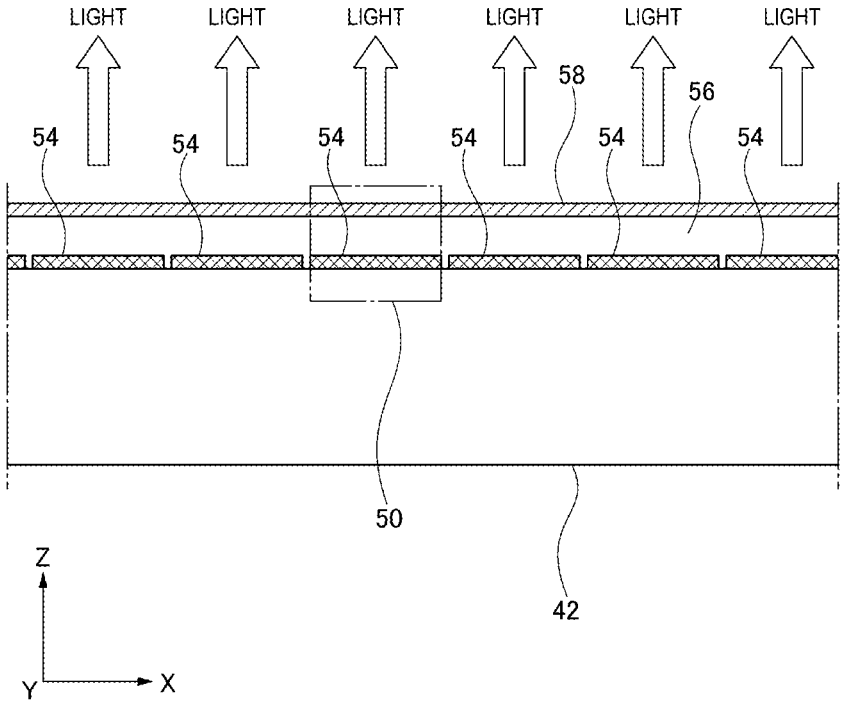
FIG. 5 is a sectional view of the light-emitting element array chip.
Figure 6:
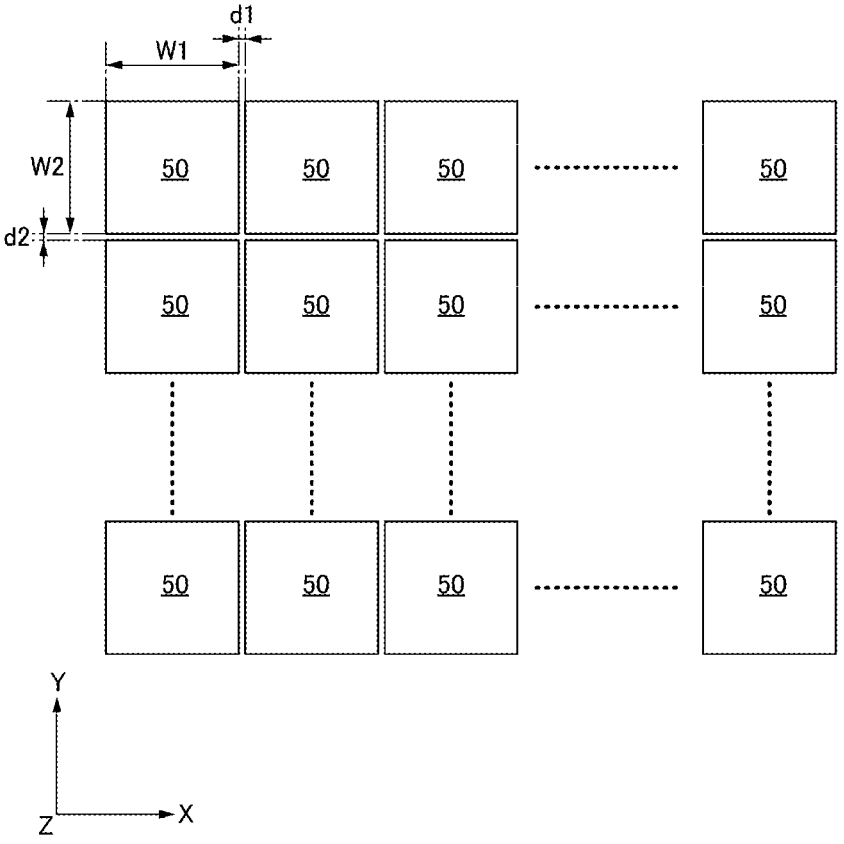
FIG. 6 is an explanatory schematic view of the arrangement of light-emitting portions.

FIG. 4 is a schematic view of a light-emitting element array chip 40. FIG. 5 is a sectional view taken along line M-M of FIG. 4. FIG. 6 is an explanatory schematic view of the arrangement of light-emitting portions 50.

As illustrated in FIG. 4, the light-emitting element array chip 40 includes a light-emitting substrate 42 having a circuit portion 46 that controls each light-emitting portion 50, built therein, a light-emitting region 44 in which the plurality of light-emitting portions 50 is disposed regularly on the light-emitting substrate 42, and wire-bonding pads 48. Signal output/signal input between the circuit portion 46 and the outside of the light-emitting element array chip 40 and power supply to the circuit portion 46 are performed through the wire-bonding pads 48. Note that, as the circuit portion 46, an analog drive circuit, a digital control circuit, or a circuit including both thereof can be used.

As illustrated in FIG. 5, the light-emitting portions 50 are formed with the light-emitting substrate 42, a plurality of lower electrodes 54 two-dimensionally arranged at regular intervals in the X direction (at intervals d1 as illustrated in FIG. 6) and at regular intervals in the Y direction (at intervals d2 as illustrated in FIG. 6) on the light-emitting substrate 42, a light-emitting layer 56, and an upper electrode 58.

The plurality of lower electrodes 54 (first electrode layer including a plurality of electrodes) is layered and separated from each other on the light-emitting substrate 42, and each is provided corresponding to a pixel. That is, each lower electrode 54 is provided for formation of one pixel.

The upper electrode 58 (second electrode layer) is stacked on the light-emitting layer 56 opposite the lower electrodes 54 through the light-emitting layer 56. The upper electrode 58 allows light having the wavelength of light emission of the light-emitting layer 56, to pass therethrough.

The circuit portion 46 controls the potential of a lower electrode 54 selected based on a control signal generated according to image data, to cause a potential difference between the selected lower electrode 54 and the upper electrode 58. The potential difference between the upper electrode 58 serving as the anode and the lower electrode 54 serving as the cathode causes electrons to flow from the cathode into the light-emitting layer 56 and electron holes to flow from the anode into the light-emitting layer 56. Recombination of the electrons and electron holes in the light-emitting layer 56 brings the light-emitting layer 56 into light emission.

Light to the upper electrode 58 due to light emission of the light-emitting layer 56 is emitted through the upper electrode 58. Light from the light-emitting layer 56 to the lower electrode 54 is reflected from the lower electrode 54 to the upper electrode 58, so that the reflected light is emitted through the upper electrode 58. As above, the light-emitting portion 50 emits light. Note that a time lag occurs in emission timing between the light emitted directly from the light-emitting layer 56 through the upper electrode 58 and the light emitted through the upper electrode 58 after reflected from the lower electrode 54, but the respective emission timings thereof can be regarded as substantially the same because the thickness of the light-emitting portion 50 is extremely thin.

Note that, in the present embodiment, the light-emitting substrate 42 is a silicon substrate. Preferably, the upper electrode 58 is transparent to the wavelength of light emission of the light-emitting layer 56. For example, use of a transparent electrode of indium tin oxide (ITO) leads to substantially 100% in aperture ratio, so that light emitted in the light-emitting layer 56 is emitted through the upper electrode 58 without any change. In the present embodiment, the upper electrode 58 serves as the anode provided in common to the lower electrodes 54. However, upper electrodes 58 may be provided one-to-one to the lower electrodes 54, or one upper electrode 58 may be provided for every predetermined multiple of lower electrodes 54.

As the light-emitting layer 56, for example, an organic EL layer or an inorganic EL layer is used. In a case where an organic EL layer is used as the light-emitting layer 56, the light-emitting layer 56 may be a stack structure including, as necessary, a functional layer, such as an electron transport layer, a hole transport layer, an electron injection layer, a hole injection layer, an electron blocking layer, or a hole blocking layer. The light-emitting layer 56 may be continuously formed in the X direction or may be divided into parts each similar in size to a lower electrode 54. The lower electrodes 54 may be brought into a plurality of groups, and one light-emitting layer 56 may be stacked on the lower electrodes 54 belonging to each group.

Note that, in a case where an organic EL layer or an inorganic EL layer that is made of a light-emitting material vulnerable to moisture, is used as the light-emitting layer 56, desirably, the light-emitting region 44 is sealed against moisture intrusion. For sealing, as a sealing film, for example, a thin film of silicon oxide, a thin film of silicon nitride, and a thin film of aluminum oxide are formed singly or in a stack. Preferably, a method of forming a sealing film excels in the performance of coating a step structure, and thus, for example, an atomic layer deposition (ALD) method can be used. Note that the material and configuration of a sealing film and the method of forming a sealing film are not limited to the above examples, and thus appropriate selections can be made.

As the material of the lower electrodes 54, preferably, used is a metal high in reflectivity to the wavelength of light emission of the light-emitting layer 56. For example, Ag, Al, or an alloy of Ag and Al is used. The lower electrodes 54 are formed in an Si process together with formation of the circuit portion 46 and are directly connected to the drive portion of the circuit portion 46. As above, the formation of the lower electrodes 54 due to an Si process leads to a process rule of approximately 0.2 m that is high in accuracy, so that the lower electrodes 54 can be accurately disposed at a high density. Furthermore, because the lower electrodes 54 can be disposed at a high density, most of the light-emitting region 44 can be brought into light emission, so that a rise can be made in the utilization efficiency of the light-emitting region 44. Note that the space between each lower electrode 54 is filled with the organic material of the light-emitting layer 56, so that each lower electrode 54 is partitioned by the organic material.

Here, the current that flows in a light-emitting portion 50 and the quantity of light emission are substantially in a proportional relationship. Thus, control of the current that flows in the light-emitting portion 50 enables control of the light quantity of the light-emitting portion 50. The light-emitting portion 50 has a threshold voltage. When the voltage across both ends of the light-emitting portion 50 exceeds the threshold voltage, current starts to flow in the light-emitting portion 50. Then, as the voltage increases, the current increases almost linearly. Because variations are present in threshold voltage between light-emitting portions 50, the voltage at which current starts to flow slightly varies between light-emitting portions 50. Thus, before product shipping from a factory, the light-emitting portions 50 in a light-emitting element array chip 40 are individually brought into light emission in sequence, and the current that flows in each light-emitting portion 50 is adjusted such that light focused through the rod lens array 23 has a predetermined light quantity. Note that, before product shipping from a factory, an exposure head 6 is subjected not only to such adjustment in light quantity as described above but also to focus adjustment that is adjustment of the interval between each light-emitting element array chip 40 and the rod lens array 23.

As illustrated in FIG. 6, the light-emitting portions 50 are two-dimensionally arranged at predetermined intervals in the X direction and at predetermined intervals in the Y direction in the light-emitting region 44. That is, in the light-emitting region 44 of one light-emitting element array chip 40, a plurality of light-emitting portions 50 is arranged in the X direction, and a light-emitting row is formed of the plurality of light-emitting portions 50 arranged in the X direction. Such a plurality of light-emitting rows is arranged in the Y direction. In the present embodiment, the number of light-emitting rows is six.

In the present embodiment, the width W1 in the X direction of each light-emitting portion 50 is 20.90 μm, and the interval d1 between adjacent light-emitting portions 50 in the X direction is 0.26 μm. That is, the light-emitting portions 50 are arranged at pitches of 21.16 μm (1200 dpi)

in the X direction. The width W2 in the Y direction of each light-emitting portion 50 is 20.90 μm, namely, is equal to its width W1. The interval d2 between adjacent light-emitting portions 50 in the Y direction is 0.26 μm, namely, is equal to the interval d1. Thus, the light-emitting portions 50 are arranged at pitches of 21.16 μm (1200 dpi) in the Y direction. That is, each light-emitting portion 50 in the present embodiment is shaped as a square of which each side is 20.90 μm, and has an area of 436.81 $\mu m^2$. The area accounts for approximately 97.6% of an area of 447.7456 $\mu m^2$ that one pixel has. An organic light-emitting material is less in light quantity than an LED. Thus, each light-emitting portion 50 shaped as a square with a small distance between adjacent light-emitting portions 50 as described above enables securement of an area for light emission for acquisition of a level of light quantity enabling a change in the potential of the photoconductive drum 1.

Note that, desirably, each light-emitting portion 50 has an area that is 90% or more of the area that one pixel occupies. Therefore, for an image forming apparatus A having an output resolution of 1200 dpi, desirably, light-emitting portions 50 are each formed so as to have each side having a width of approximately 20.07 μm or more. For an image forming apparatus A having an output resolution of 2400 dpi, desirably, light-emitting portions 50 are each formed so as to have each side having a width of approximately 10.04 μm or more. The shape of each light-emitting portion 50 is not limited to a square, and may be, for example, an n-gon (n is an integer of 4 or more), a circle, or an ellipse as long as each light-emitting portion 50 emits light covering the size of an exposure region corresponding to the output resolution of the image forming apparatus A and an output image has a level of quality fulfilling the design specification of the image forming apparatus A. The interval d2 between adjacent light-emitting portions 50 in the Y direction and the number of rows of light-emitting portions 50 in the Y direction are determined, for example, based on the scanning rate of an exposure head 6, the light quantity required in exposure processing, and resolution.

Figure 7A:
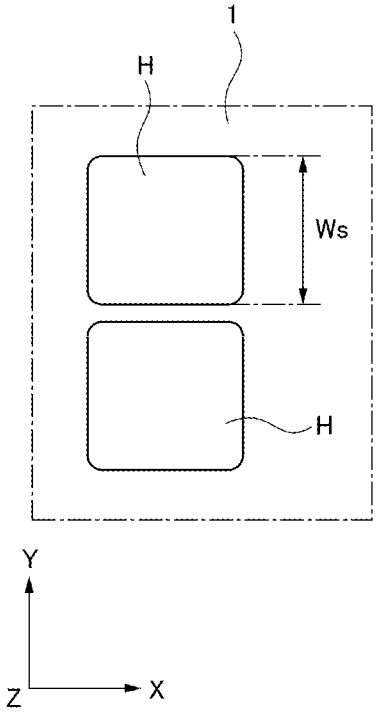
FIGS. 7A and 7B are explanatory schematic views of the irradiated positions of a photoconductive drum with light emitted from two light-emitting portions adjacent in the sub-scanning direction.
Figure 7B:
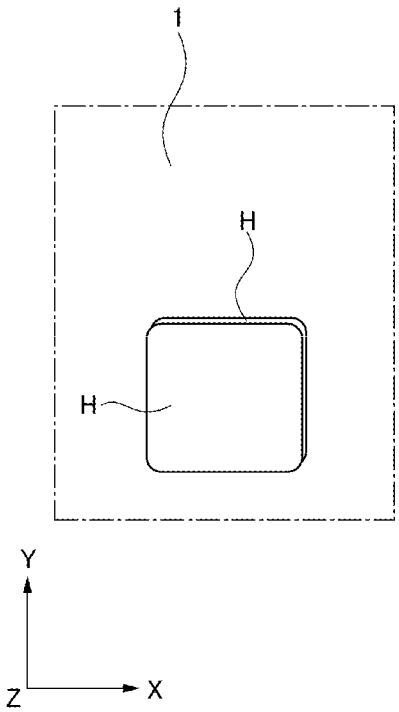

FIGS. 7A and 7B are explanatory schematic views of the irradiated positions of a photoconductive drum 1 with light emitted from two light-emitting portions 50 adjacent in the Y direction. As illustrated in FIG. 7A, when the two light-emitting portions 50 adjacent in the Y direction light up simultaneously, the irradiated positions of the photoconductive drum 1 with the respective rays of light H emitted from the two light-emitting portions 50 are adjacent in the rotational direction of the photoconductive drum 1 (Y direction, namely, sub-scanning direction) like the positional relationship between the two light-emitting portions 50. In contrast to this, as illustrated in FIG. 7B, when the timings at which the two light-emitting portions 50 light up are made different according to the rotational rate of the photoconductive drum 1, the irradiated positions of the photoconductive drum 1 with the respective rays of light H emitted from the two light-emitting portions 50 can be made substantially the same. As above, irradiating positions substantially the same on the photoconductive drum 1 with light from a plurality of light-emitting portions 50 arranged in the Y direction is referred to as multiple exposure. A larger number of light-emitting portions 50 arranged in the Y direction for use in multiple exposure causes a larger received light quantity at part of the photoconductive drum 1 at the time of multiple exposure.

In order to make the irradiated positions of the photoconductive drum 1 with light emitted from two light-emitting portions 50 adjacent in the Y direction, identical to each other, the timing of lighting of the downstream light-emitting portion 50 in the rotational direction of the photoconductive drum 1 needs delaying by a delay quantity T in time to the timing of lighting of the upstream light-emitting portion 50. Here, the delay quantity T (s) is calculated by the following Expression 1 with the rotational rate Vdr (mm/s) of the photoconductive drum 1, the width W2 (μm) of each of the two light-emitting portions 50 in the Y direction, and the interval d2 (μm) between the two light-emitting portions 50 in the Y direction.

$$T=((W2+d2)/1000)/Vdr \quad \text{(Expression 1)}$$

In the present embodiment, a signal for light emission is generated such that the maximum value Tw (s) of the duration of light emission of each light-emitting portion 50 is equivalent to the time for one line in the sub-scanning direction. The maximum value Tw (s) is expressed by the following Expression 2 with a resolution of 1200 dpi and the rotational rate Vdr (mm/s) of the photoconductive drum 1.

$$Tw=(25.4/1200)/Vdr \quad \text{(Expression 2)}$$

<System Configuration of Exposure Head>

Next, the system configuration of the image controller 70 provided on the body side of the image forming apparatus A and an exposure head 6 will be described. Processing for one color from among four colors of yellow, magenta, cyan, and black will be described below. In an image forming operation, for the four colors, similar pieces of processing are performed in parallel.

FIG. 8 is a block diagram of the system configuration of the image controller 70 and an exposure head 6. As illustrated in FIG. 8, the image controller 70 includes an image data signal generation portion 71 (image data signal generation portion), a chip data conversion portion 72 (image data signal transmission portion), and a synchronizing signal generation portion 74 (control signal generation portion), in addition to the CPU 73 (controller).

The image controller 70 including the portions described above performs processing of image data and processing of image forming timing and transmits a control signal for control of the exposure head 6 to the printed circuit board 22 of the exposure head 6. Specifically, the control signal includes an image data signal, a chip select signal, a clock signal, a line synchronizing signal, and a communication signal from the CPU 73. The signals are transmitted from the image controller 70 to the exposure head 6 through the corresponding signal lines to be described below.

The image data signal generation portion 71 receives image data of an original read by the image reading portion 90 or image data transferred from an external device through a network. The image data signal generation portion 71 performs dithering to the received image data at the resolution based on an instruction from the CPU 73, and generates an image data signal for output of an image. In the present embodiment, the image data signal generation portion 71 performs dithering at a resolution of 1200 dpi. The image data signal indicates eight levels of gray with the density value ranging from 0 to 7 with a 3-bit width. The density value 0 indicates the minimum density, and the density value 7 indicates the maximum density. Note that the CPU 73 transmits a communication signal for various types of instructions to the image data signal generation portion 71 through a communication signal line 79.

The synchronizing signal generation portion 74 periodically generates a line synchronizing signal indicating a partition for one line in the main scanning direction of the image data signal. In other words, the synchronizing signal generation portion 74 periodically generates a line synchronizing signal as a control signal that controls the timing of start of light emission of a light-emitting portion 50 selected according to the image data signal at the time of formation of an electrostatic latent image for one line in the main scanning direction. For image forming in the normal mode, with, as a one-line cycle, the cycle in which the surface of the photoconductive drum 1 moves, in the rotational direction, by the pixel size corresponding to the resolution in the sub-scanning direction to the previously set rotational rate of the photoconductive drum 1, the CPU 73 gives the synchronizing signal generation portion 74 an instruction for the cycle for a line synchronizing signal. Specifically, in the normal mode, the CPU 73 instructs the synchronizing signal generation portion 74 to generate a line synchronizing signal every time the photoconductive drum 1 rotates by a pitch (approximately 21.16 μm) at a resolution of 1200 dpi. For example, when the photoconductive drum 1 rotates at 200 mm/s in the normal mode, the synchronizing signal generation portion 74 generates a line synchronizing signal at a cycle of 105.8 μs.

As described below, the chip data conversion portion 72 includes a line buffer 15 and receives and stores the image data signal from the image data signal generation portion 71. Then, in synchronization with the line synchronizing signal input through a line synchronizing signal line 78 after generated by the synchronizing signal generation portion 74 and according to an instruction from the CPU 73, the chip data conversion portion 72 divides an image data signal for one line for the light-emitting element array chips 40 and transmits the divided image data signals for one line to the light-emitting element array chips 40 through an image data signal line 77. The chip data conversion portion 72 transmits, to each light-emitting element array chip 40, a chip select signal indicating the effective range of the image data signal and a clock signal, respectively, through a chip select signal line 75 and a clock signal line 76.

A head information storage portion 171 included in the exposure head 6 is in connection with the CPU 73 through the communication signal line 79. The head information storage portion 171 stores, as head information, the quantity of light emission of each light-emitting element array chip 40 and information regarding the mounted location of each light-emitting element array chip 40. The chip select signal line 75, the clock signal line 76, the image data signal line 77, the line synchronizing signal line 78, and the communication signal line 79 are each in connection with each light-emitting element array chip 40. Based on the respective set values of the signals input from the image controller 70 through the signal lines described above, each light-emitting element array chip 40 brings a light-emitting portion 50 into light emission. Each light-emitting element array chip 40 is in cascade-connection with another light-emitting element array chip 40 through the chip select signal line 75. Each light-emitting element array chip 40 generates a chip select signal to be used in the other light-emitting element array chip 40 and transmits the generated chip select signal to the other light-emitting element array chip 40 through the chip select signal line 75.

<Chip Data Conversion Portion>

Next, the configuration of the chip data conversion portion 72 will be described.

Figure 9:
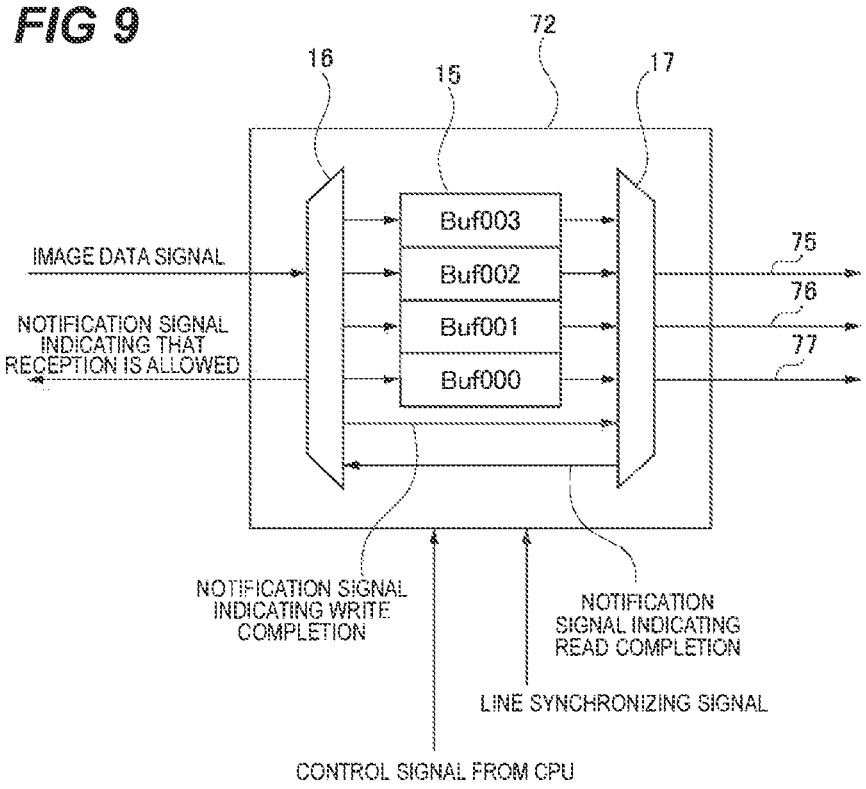
FIG. 9 is a block diagram of the configuration of a chip data conversion portion.

FIG. 9 is a block diagram of the configuration of the chip data conversion portion 72. As illustrated in FIG. 9, the chip data conversion portion 72 includes a buffer write controller 16 and a buffer read controller 17, in addition to the line buffer 15. The CPU 73 transmits a control signal to the chip data conversion portion 72, to control the line buffer 15, the buffer write controller 16, and the buffer read controller 17.

The buffer write controller 16 transmits, to the image data signal generation portion 71, a notification signal indicating that reception is allowed. Thus, the image data signal generation portion 71 outputs an image data signal. The buffer write controller 16 stores, on a one-line basis, the image data signal output from the image data signal generation portion 71, into the line buffer 15. The line buffer 15 has four data storage regions (Buf000 to Buf003), and an image data signal for one line is stored in cycles of Buf000, Buf001, Buf002, and Buf003. Every time an image data signal for one line is stored in the line buffer 15, the buffer write controller 16 transmits, to the buffer read controller 17, a notification signal indicating write completion. In a case where the data storage regions of the line buffer 15 are full, the buffer write controller 16 stops the transmission of the notification signal indicating that reception is allowed to the image data signal generation portion 71, to stop the output of the image data signal.

When receiving the notification signal indicating write completion, in synchronization with a line synchronizing signal, the buffer read controller 17 divides an image data signal for one line stored in the line buffer 15 for allocation to the light-emitting element array chips 40 and transmits the divided image data signals for one line together with a clock signal and a chip select signal to the light-emitting element array chips 40. After transmitting the image data signal for one line to the light-emitting element array chips 40, the buffer read controller 17 transmits a notification signal indicating read completion to the buffer write controller 16, to notify the buffer write controller 16 that one of the data storage regions of the line buffer 15 is empty. According to an instruction from the CPU 73, the buffer read controller 17 can transmit, to the light-emitting element array chips 40, an image data signal for bringing all the light-emitting portions 50 in the exposure head 6 into non-lighting, instead of transmitting the image data signal stored in the line buffer 15. The image data signal for bringing all the light-emitting portions 50 in the exposure head 6 into non-lighting has elements that are all "0" or "1".

<System Configuration of Light-Emitting Element Array Chip>

Next, the system configuration of a light-emitting element array chip 40 will be described.

Figure 10:
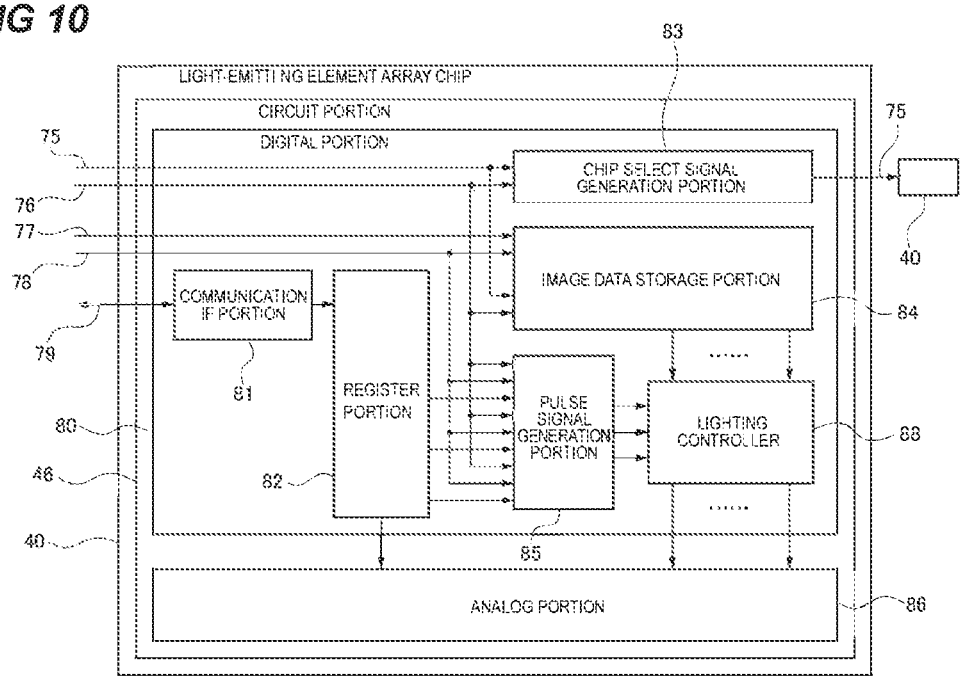
FIG. 10 is a block diagram of the system configuration of a light-emitting element array chip.

FIG. 10 is a block diagram of the system configuration of a light-emitting element array chip 40. As illustrated in FIG. 10, the circuit portion 46 of the light-emitting element array chip 40 includes a digital portion 80 and an analog portion 86. As described below, the analog portion 86 generates a signal for driving a light-emitting portion 50, based on a pulse signal generated by the digital portion 80.

The digital portion 80 includes a communication IF portion 81, a register portion 82, a chip select signal generation portion 83, an image data storage portion 84, and a pulse signal generation portion 85. Based on a set value set in advance by the communication signal, the chip select signal, the image data signal, and the line synchronizing signal, in synchronization with the clock signal, the digital portion 80 including the portions generates a pulse signal for bringing a light-emitting portion 50 into light emission and transmits the pulse signal to the analog portion 86.

Based on the communication signal input from the CPU 73, the communication IF portion 81 controls write and read of the set value to the register portion 82. The register portion 82 stores the set value necessary for operation. The set value includes information on the width of a pulse signal to be generated by the pulse signal generation portion 85, information on the cycle of the line synchronizing signal, set information on a driving current to be set by the analog portion 86, and information on the rotational rate of the photoconductive drum 1 in each of the normal mode and the low mode.

The chip select signal generation portion 83 delays the input chip select signal to generate a chip select signal for use in another light-emitting element array chip 40 connected through the chip select signal line 75. The image data storage portion 84 retains the image data signal while the input chip select signal is valid, and outputs, in synchronization with the line synchronizing signal, the image data signal to a lighting controller 88.

Based on the cycle of the line synchronizing signal and the information on the width of a pulse signal stored in the register portion 82, the pulse signal generation portion 85 generates a pulse signal that controls the timing of light emission of a light-emitting portion 50 and outputs the generated pulse signal to the lighting controller 88. Based on the image data signal output from the image data storage portion 84, the lighting controller 88 determines, for each light-emitting portion 50, whether or not the pulse signal generated by the pulse signal generation portion 85 is to be output to the analog portion 86, and then outputs the pulse signal to the analog portion 86.

<Image Data Storage Portion>

Next, the configuration of the image data storage portion 84 will be described.

Figure 11:
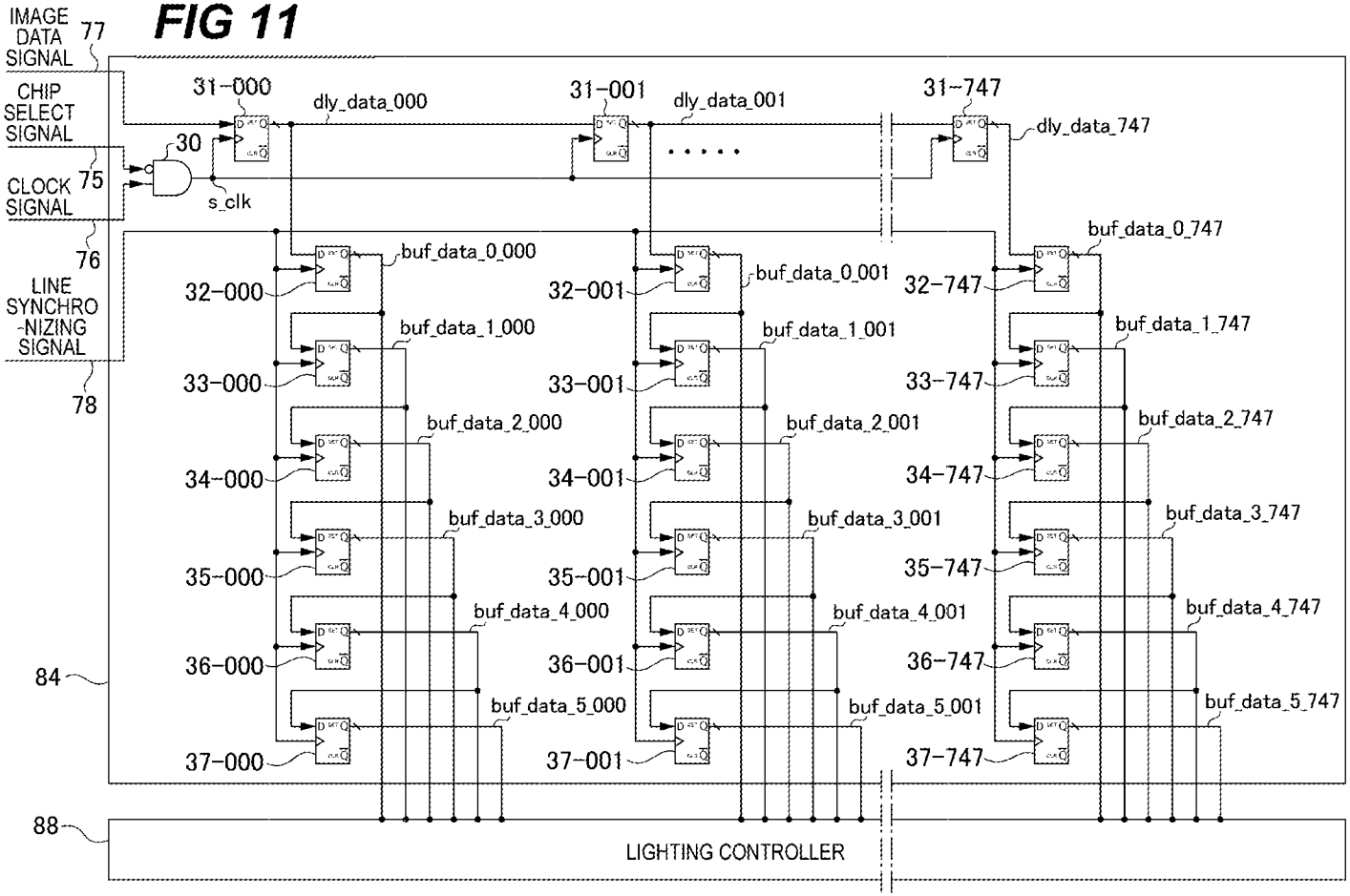
FIG. 11 is a circuit configuration diagram of an image data storage portion.

FIG. 11 is a circuit configuration diagram of the image data storage portion 84. Note that, in FIG. 11, the image data signal is denoted with "data". The chip select signal and the line synchronizing signal are each a negative logic signal, but may be each a positive logic signal.

As illustrated in FIG. 11, the image data storage portion 84 includes a clock gate circuit 30 and flip-flop circuits 31 to 37. The flip-flop circuit 31 (31-000 to 31-747) receives, as the original input, the image data signal data input to the image data storage portion 84, and includes 748 flip-flop circuits connected in series identical in number to the light-emitting portions 50 in the X direction of the light-emitting element array chip 40.

Similarly, the flip-flop circuits 32 to 37 each include flip-flop circuits identical in number to the light-emitting portions 50 in the X direction of the light-emitting element array chip 40 (32-000 to 32-747, 33-000 to 33-747, 34-000 to 34-747, 35-000 to 35-747, 36-000 to 36-747, and 37-000 to 37-747).

The clock gate circuit 30 outputs the logical product of the inverted signal of the chip select signal and the clock signal and outputs the clock signal to the flip-flop circuit 31 only when the chip select signal is valid. The flip-flop circuit 31 operates due to the clock signal sent from the clock gate circuit 30 and outputs the image data signal (dly_data_000).

With the output of the flip-flop circuit 31-000 as an input, the flip-flop circuit 32-000 operates due to the line synchronizing signal. The output (buf_data_0_000) of the flip-flop circuit 32-000 is input to the flip-flop circuit 33-000 and the lighting controller 88.

With the output of the flip-flop circuit 32-000 as an input, the flip-flop circuit 33-000 operates due to the line synchronizing signal. The output (buf_data_1_000) of the flip-flop circuit 33-000 is input to the flip-flop circuit 34-000 and the lighting controller 88.

With the output of the flip-flop circuit 33-000 as an input, the flip-flop circuit 34-000 operates due to the line synchronizing signal. The output (buf_data_2_000) of the flip-flop circuit 34-000 is input to the flip-flop circuit 35-000 and the lighting controller 88.

With the output of the flip-flop circuit 34-000 as an input, the flip-flop circuit 35-000 operates due to the line synchronizing signal. The output (buf_data_3_000) of the flip-flop circuit 35-000 is input to the flip-flop circuit 36-000 and the lighting controller 88.

With the output of the flip-flop circuit 35-000 as an input, the flip-flop circuit 36-000 operates due to the line synchronizing signal. The output (buf_data_4_000) of the flip-flop circuit 36-000 is input to the flip-flop circuit 37-000 and the lighting controller 88.

With the output of the flip-flop circuit 36-000 as an input, the flip-flop circuit 37-000 operates due to the line synchronizing signal. The output (buf_data_5_000) of the flip-flop circuit 37-000 is input to the lighting controller 88.

Note that the flip-flop circuits 32-001 to 32-747, 33-001 to 33-747, 34-001 to 34-747, 35-001 to 35-747, 36-001 to 36-747, and 37-001 to 37-747 operate similarly to the flip-flop circuits 32-000 to 37-000 described above.

Figure 12:
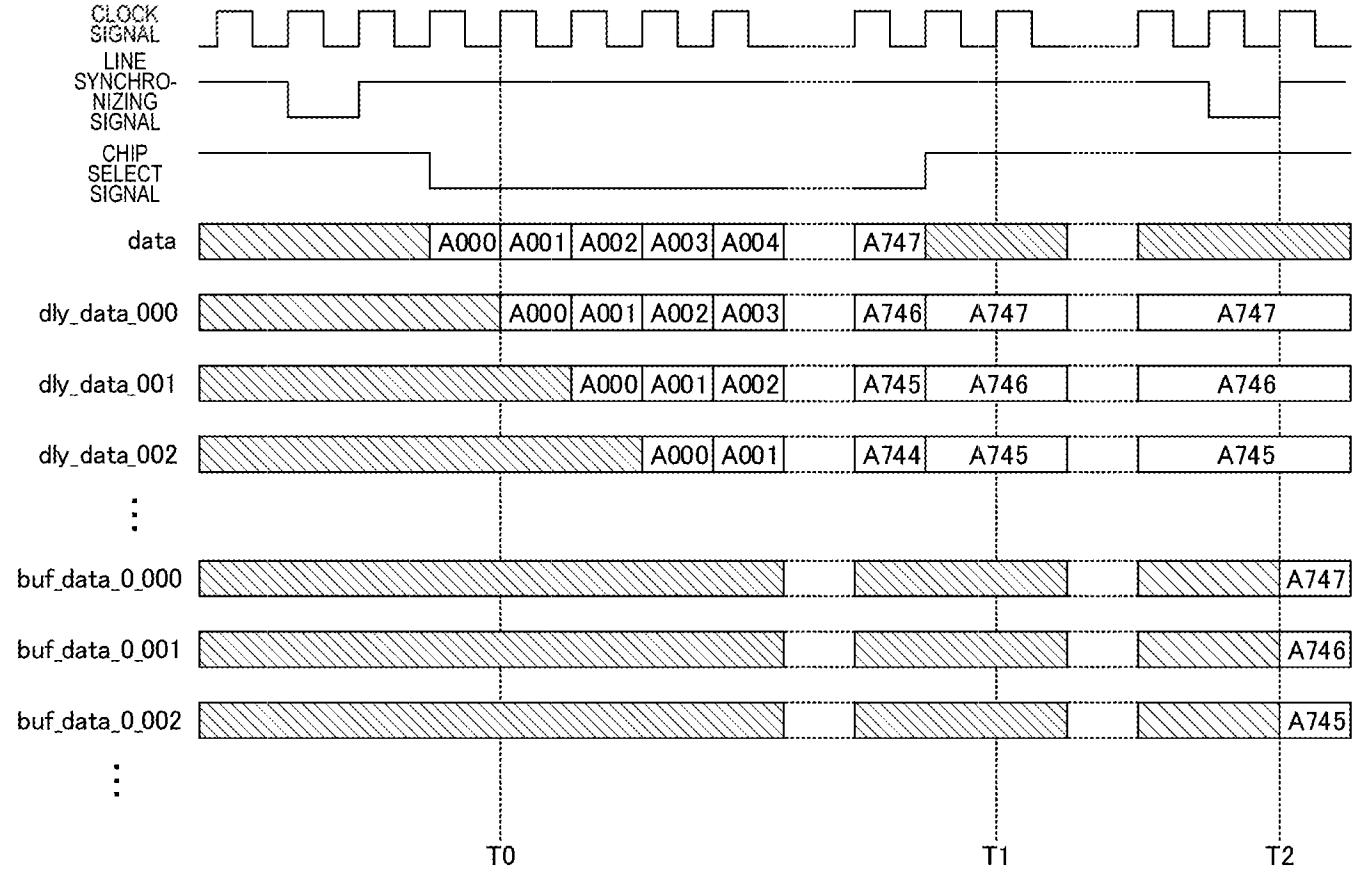
FIG. 12 is a timing chart of the operation in the main scanning direction of the image data storage portion.

FIG. 12 is a timing chart of the operation in the main scanning direction of the image data storage portion 84. Reference signs in FIG. 12 are the same as those in FIG. 11 in meaning. As illustrated in FIG. 12, from time T0 at which the chip select signal has a low output at a rise in the clock signal to time T1, the image data signal shifts, for example, in the order from data to dly_data_000 to dly_data_001. The low output of the chip select signal is input so as to cover 748 pulses in the clock signal identical in number to the light-emitting portions 50 in the main scanning direction. Thus, an image data signal for one line is retained as dly_data_000 to dly_data_747.

Because the chip select signal is high after time T1, retention is performed with no shift operation. At time T2 at which the line synchronizing signal has a low output at a rise in the clock signal, the image data signal for one line shifts at a time as buf_data_0_000 to buf_data_0_747, for example, from dly_data_000 to buf_data_0_000 and from dly_data_001 to buf_data_0_001 and then is output to the lighting controller 88.

Figure 13:
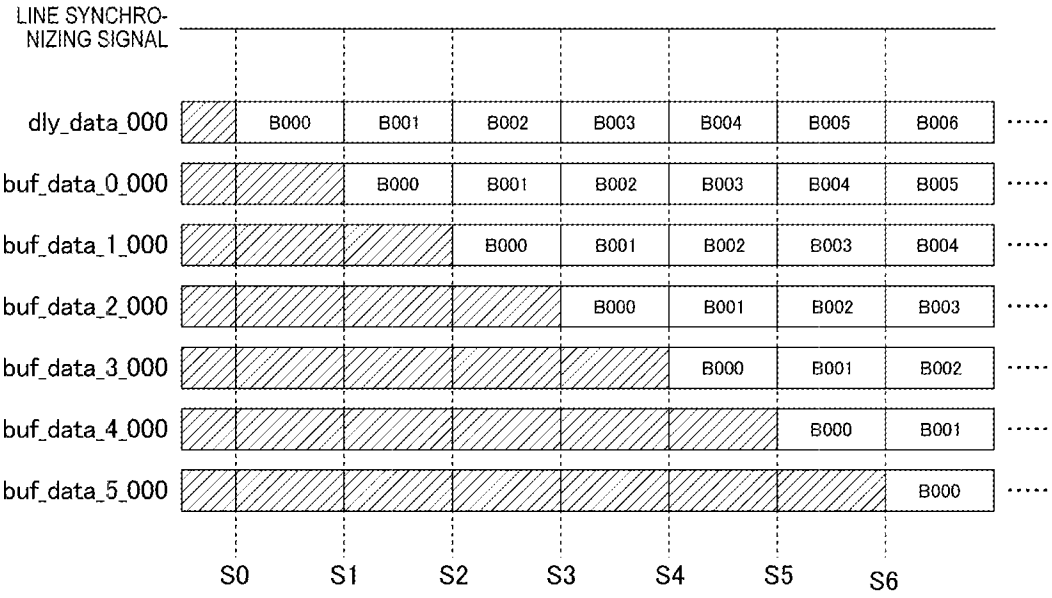
FIG. 13 is a timing chart of the operation in the sub-scanning direction of the image data storage portion in the normal mode.

FIG. 13 is a timing chart of the operation in the sub-scanning direction of the image data storage portion 84 in the normal mode. Reference signs in FIG. 13 are the same as those in FIG. 11 in meaning. The outputs buf_data_0_000, buf_data_1_000, buf_data_2_000, buf_data_3_000, buf_data_4_000, and buf_data_5_000 of the flip-flop circuits 32-000, 33-000, 34-000, 35-000, 36-000, and 37-000 illustrated in FIG. 11 will be described below. The same applies to buf_data_0_001 to buf_data_0_747, buf_data_1_001 to buf_data_1_747, buf_data_2_001 to buf_data_2_747, buf_data_3_001 to buf_data_3_747, buf_data_4_001 to buf_data_4_747, and buf_data_5_001 to buf_data_5_747 about which no description will be given below.

As illustrated in FIG. 13, every rise from low to high in the line synchronizing signal, a shift is made, for example, from dly_data_000 to buf_data_0_000 or from buf_data_0_000 to buf_data_1_000. Thus, the value of B000 in dly_data_000 at time S0 is output, for example, as buf_data_0_000 at time S1, buf_data_1_000 at time S2, and buf_data_2_000 at time S3, to the lighting controller 88.

As above, the first light-emitting portion 50 to the last light-emitting portion 50 for exposure on the photoconductive drum 1 are connected, respectively, to buf_data_0_000, buf_data_1_000, buf_data_2_000, buf_data_3_000, buf_data_4_000, and buf_data_5_000, enabling achievement of multiple exposure.

<Analog Portion>

Next, the configuration of the analog portion 86 will be described. Note that, in the following description, two drive portions 61 that drive, respectively, two light-emitting portions 50 will be given. Similarly, all the light-emitting portions 50 are driven one-to-one by similar drive portions 61.

Figure 14:
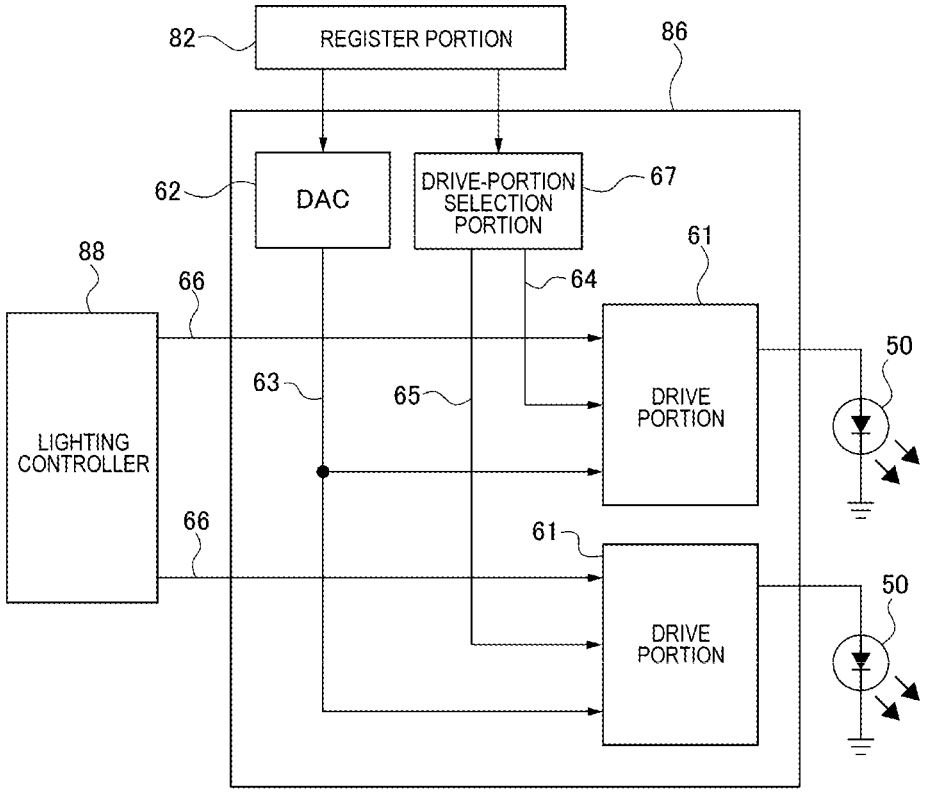
FIG. 14 is a block diagram of the configuration of an analog portion.

FIG. 14 is a block diagram of the configuration of the analog portion 86. As illustrated in FIG. 14, the analog portion 86 includes a drive portion 61 that drives a light-emitting portion 50, a DAC 62 serving as a digital/analog converter, and a drive-portion selection portion 67.

Based on the data set in the register portion 82, the DAC 62 supplies, through a signal line 63, the drive portion 61 with an analog voltage that determines a drive current. The pulse signal output from the lighting controller 88 is input to the drive portion 61 through a signal line 66. As above, the drive portion 61 receives the analog voltage that determines a drive current and the pulse signal. Then, based on the signals, the drive portion 61 controls the drive current to the light-emitting portion 50 and the duration of light emission of the light-emitting portion 50, with a drive circuit to be described below.

Based on the data set in the register portion 82, the drive-portion selection portion 67 supplies two drive portions 61 with a drive-portion select signal that selects a drive portion 61 through signal lines 64 and 65. Here, a high drive-portion select signal is generated to a drive portion 61 to be selected. For example, in order to select the upper drive portion 61 illustrated in FIG. 14, a high drive-portion select signal is supplied to only the signal line 64 and a low drive-portion select signal is supplied to the signal line 65. At the timing at which the drive-portion select signal becomes high to each of the two drive portions 61, the DAC 62 sets, to each of the two drive portions 61, an analog voltage that determines a drive current. As above, the CPU 73 successively selects a drive portion 61 through the register portion 82 and sets an analog voltage to the selected drive portion 61, so that analog voltages are set to all the drive portions 61 with a single DAC 62.

<Drive Portion>

Next, the configuration of a drive portion 61 will be described.

Figure 15:
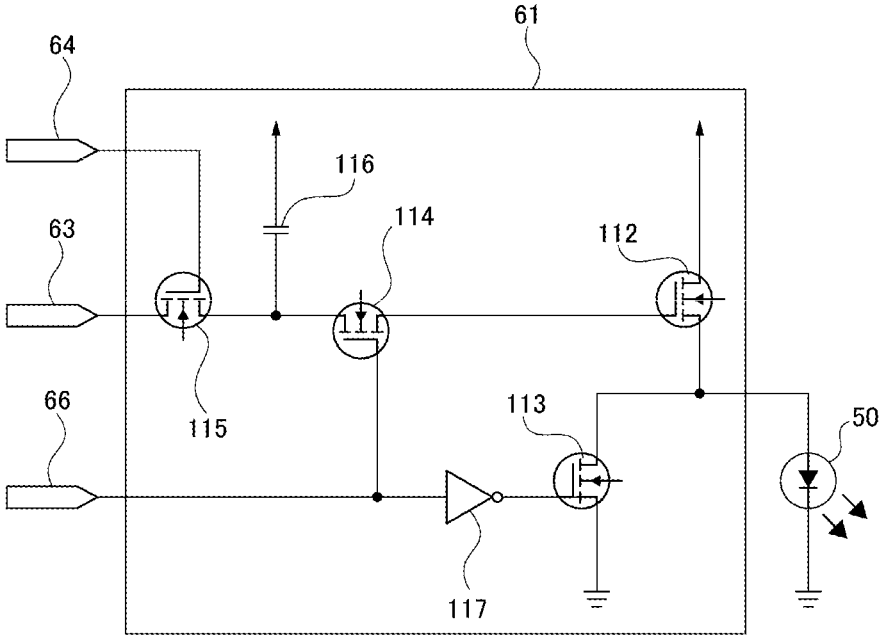
FIG. 15 is a circuit diagram of a drive portion.

FIG. 15 is a circuit diagram of a drive portion 61. As illustrated in FIG. 15, the drive portion 61 includes MOSFETs 112 to 115, a capacitor 116, and an inverter 117.

According to a value of gate voltage, the MOSFET 112 supplies a drive current to the light-emitting portion 50. When the gate voltage is low in level, the MOSFET 112 controls the drive current to be off (non-lighting). The MOSFET 114 has its gate to which the signal line 66 is connected. When the pulse signal input through the signal line 66 is high, the MOSFET 114 transfers, to the MOSFET 112, the voltage charged in the capacitor 116.

The MOSFET 115 has its gate to which the signal line 64 is connected for reception of the drive-portion select signal transmitted from the drive-portion selection portion 67. In response to input of a high drive-portion select signal, the MOSFET 115 switches on, so that the capacitor 116 is charged with the analog voltage transmitted through the signal line 63 after output from the DAC 62. In the present embodiment, the DAC 62 sets an analog voltage to the capacitor 116 at the timing before image forming, and keeps the MOSFET 115 off during image forming operation, leading to retention of the voltage level.

Due to the above operation, the MOSFET 112 supplies a drive current to the light-emitting portion 50, according to the set analog voltage and the pulse signal. In a case where the light-emitting portion 50 has a large input capacitance and a low response rate for turning off, the MOSFET 113 can make an increase in the response rate for turning off. The MOSFET 113 has its gate to which the pulse signal logic-inverted by the inverter 117 is input. A low pulse signal brings the gate of the MOSFET 113 high, leading to forcible discharge of the electric charges charged in the input capacitance of the light-emitting portion 50.

<Control of Light-Emitting Portion in Low Mode>

As described above, the CPU 73 can perform the normal mode or the low mode at the time of image forming, and changes the rotational rate of the photoconductive drum 1 at the time of a switch between the modes. Here, in a case where, in the low mode similarly to in the normal mode, the CPU 73 controls the synchronizing signal generation portion 74 with the time during which the photoconductive drum 1 rotates by the pixel size corresponding to the resolution in the sub-scanning direction, as the cycle of the line synchronizing signal, the following problem occurs.

That is, a reduction in the rotational rate of the photoconductive drum 1 lengthens the cycle of the line synchronizing signal, causing a large quantity of light to be emitted to the region corresponding to one pixel on the photoconductive drum 1. For example, in a case where the rotational rate of the photoconductive drum 1 in the low mode is half of that in the normal mode, the cycle of the line synchronizing signal in the low mode is two times that in the normal mode, so that the quantity of light to be emitted to the region corresponding to one pixel on the photoconductive drum 1 in the low mode is two times that in the normal mode. In a case where a large quantity of light is emitted to the region corresponding to one pixel on the photoconductive drum 1, excessive toner adheres on the photoconductive drum 1 in developing an electrostatic latent image.

In order to inhibit excessive toner from adhering on the photoconductive drum 1, it can be thought that a reduction is made in light quantity with the value of current for driving a light-emitting portion 50 lower in the low mode than in the normal mode. However, a sophisticated circuit is required to drive a light-emitting portion 50 variable in light quantity. Thus, the CPU 73 performs the following control in the low mode to inhibit excessive toner from adhering on the photoconductive drum 1 with a reduction in the quantity of light to be emitted to the region corresponding to one pixel on the photoconductive drum 1.

Figure 16:
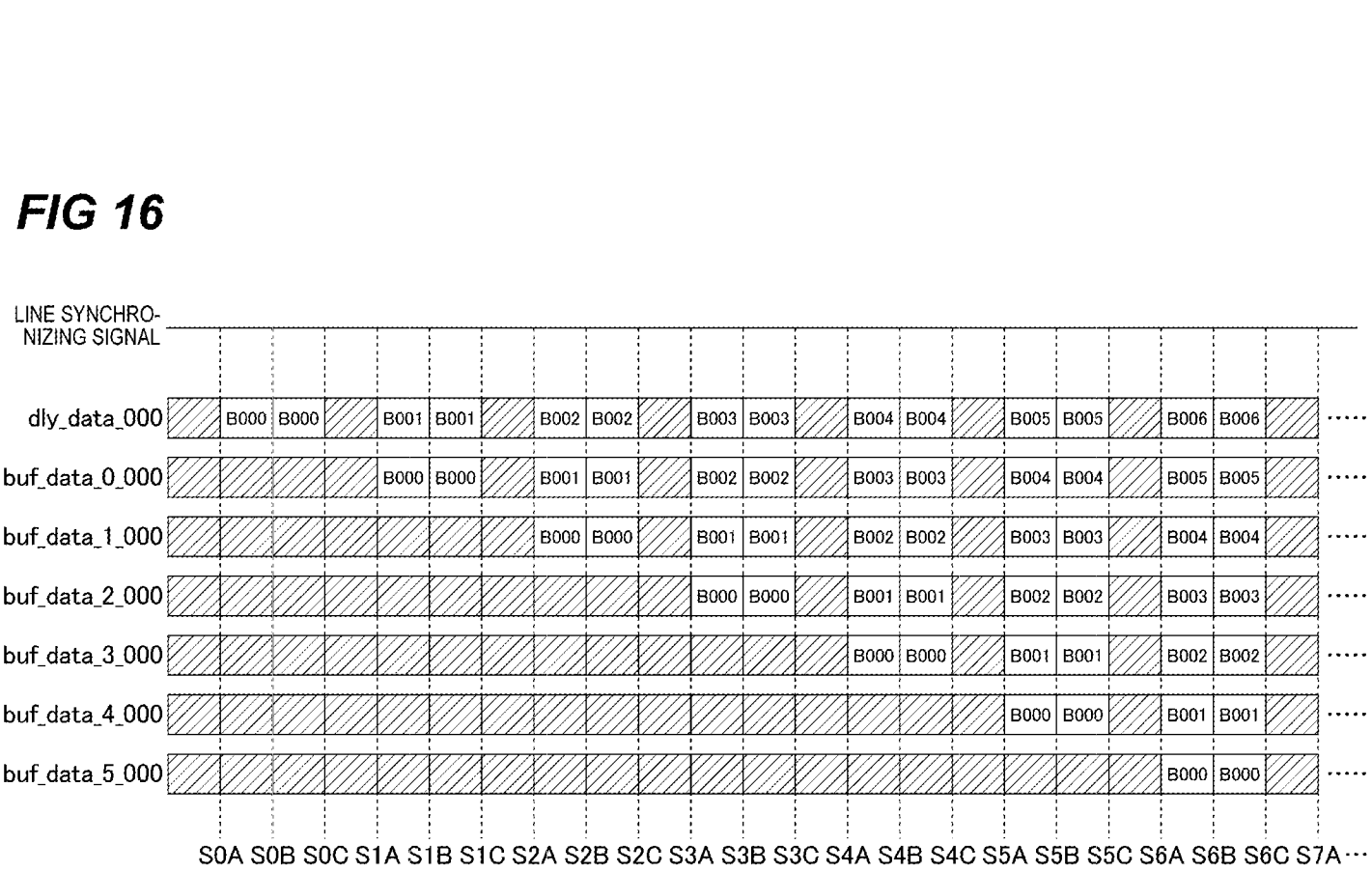
FIG. 16 is a timing chart of the operation in the sub-scanning direction of the image data storage portion in the low mode.

FIG. 16 is a timing chart of the operation in the sub-scanning direction of the image data storage portion 84 in the low mode. Herein, for example, the rotational rate of the photoconductive drum 1 in the low mode is ⅔ times the rotational rate of the photoconductive drum 1 in the normal mode. Note that reference signs in FIG. 16 are the same as those in FIG. 11 in meaning.

As illustrated in FIG. 16, the CPU 73 instructs the synchronizing signal generation portion 74 to make the cycle of the line synchronizing signal in the low mode ½ times the cycle of the line synchronizing signal in the normal mode. The numerical value "½" is determined as follows. That is, for example, the rotational rate of the photoconductive drum 1 in the low mode is m/n times the rotational rate of the photoconductive drum 1 in the normal mode. Note that, since the rotational rate of the photoconductive drum 1 is lower in the low mode than in the normal mode, the following expression is satisfied: m<n. In this case, the CPU 73 acquires a value n/m (reciprocal of m/n) times the cycle of the line synchronizing signal in the normal mode. The value acquired here corresponds to the time during which the photoconductive drum 1 moves in the rotational direction by the pixel size corresponding to the resolution in the sub-scanning direction in the low mode.

Next, the CPU 73 further acquires a value 1/n times the acquired value n/m times the cycle of the line synchronizing signal in the normal mode. The CPU 73 instructs the synchronizing signal generation portion 74 to set the value acquired in this manner as the cycle of the line synchronizing signal. Note that the cycle of the line synchronizing signal in the low mode acquired in this manner can be regarded as the time resulting from dividing, by n, the time during which the photoconductive drum 1 rotates by the pixel size corresponding to the resolution in the sub-scanning direction in the low mode.

That is, in the low mode in which the photoconductive drum 1 rotates at a rate m/n times the rotational rate in the normal mode, lower than the rotational rate in the normal mode (first rotational rate) (second rotational rate), the CPU 73 controls the synchronizing signal generation portion 74 as follows. That is, in the low mode, the CPU 73 causes the synchronizing signal generation portion 74 to generate a line synchronizing signal at a cycle 1/m times the cycle of the line synchronizing signal generated in the normal mode.

Next, the CPU 73 controls the chip data conversion portion 72 as follows. That is, the CPU 73 causes the buffer read controller 17 to read an image data signal for one line from Buf000 in the line buffer 15 and transmit the image data signal for one line to the light-emitting element array chips 40, in synchronization with the first line synchronizing signal and the second line synchronizing signal from among three line synchronizing signals generated in the time during which the photoconductive drum 1 rotates by the pixel size corresponding to the resolution in the sub-scanning direction in the low mode. That is, in synchronization with the first line synchronizing signal generated at time S0A and the second line synchronizing signal generated at time SOB, the buffer read controller 17 transmits, to the light-emitting element array chips 40, the same image data signal for one line.

Next, the CPU 73 causes the buffer read controller 17 to transmit an image data signal that brings the light-emitting portions 50 into no light emission (non-lighting) to each light-emitting element array chip 40, in synchronization with the third line synchronizing signal generated at time SOC. Thus, in synchronization with the three line synchronizing signals, the buffer read controller 17 transmits the same image data signal for one line twice and the image data signal that brings the light-emitting portions 50 into no light emission one time as three image data signals to be transmitted to the exposure head 6. Generalization of the number of times of transmission of each image data signal by the buffer read controller 17 with n and m described above leads to as follows. That is, the CPU 73 causes the buffer read controller 17 to output the same image data signal for one line m times and output the image data signal that brings the light-emitting portions 50 into no light emission n-m times, in synchronization with n number of line synchronizing signals generated in the time during which the photoconductive drum 1 rotates by the pixel size corresponding to the resolution in the sub-scanning direction in the low mode. In other words, the CPU 73 controls the chip data conversion portion 72 as above for exposure for forming an image for one line extending in the main scanning direction (rotational-axis direction of the photoconductive drum 1 or width direction of a sheet S) onto a sheet S.

Here, the duration of light emission of each light-emitting portion 50 due to two times of transmission of the same image data signal for one line to each light-emitting element array chip 40 by the chip data conversion portion 72 is equal to the duration of light emission of each light-emitting portion 50 in the time during which the photoconductive drum 1 rotates by the pixel size corresponding to the resolution in the sub-scanning direction in the normal mode. That is, the period from time S0A to time SOB illustrated in FIG. 16 is equal to the period from time S0 to time S1 illustrated in FIG. 13. The period from time S0A to time SOB illustrated in FIG. 16 corresponds to the time during which the photoconductive drum 1 rotates by the pixel size corresponding to the resolution in the sub-scanning direction in the low mode. The same applies to the other times. Thus, in the low mode, the CPU 73 controls the chip data conversion portion 72 and the synchronizing signal generation portion 74 as above, so that the quantity of light to be emitted to the region corresponding to one pixel on the photoconductive drum 1 can be kept constant between in the normal mode and in the low mode.

Note that the CPU 73 instructs the buffer read controller 17 to transmit a notification signal indicating read completion to the buffer write controller 16 after the buffer read controller 17 transmits the image data signal to the exposure head 6 in synchronization with the second line synchronizing signal. When receiving the notification signal indicating read completion, the buffer write controller 16 generates a notification signal indicating that reception is allowed and outputs, to the image data signal generation portion 71, the generated notification signal indicating that reception is allowed. When receiving the notification signal indicating that reception is allowed, the image data signal generation portion 71 transmits the next image data signal for one line to the buffer write controller 16. The buffer write controller 16 stores, into Buf000 empty in the line buffer 15, the next image data signal for one line received from the image data signal generation portion 71. The CPU 73 instructs the buffer read controller 17 to read the image data signal from Buf001 and transmit the read image data signal to the printed circuit board 22, in synchronization with the line synchronizing signal generated at time S1A. The CPU 73 repeatedly performs the above control after time S1B for exposure processing.

In summary, in the low mode in which the photoconductive drum 1 rotates at a rate m/n times the rotational rate in the normal mode, lower than the rotational rate in the normal mode, the CPU 73 performs the following control. That is, in the low mode, the CPU 73 causes the synchronizing signal generation portion 74 to generate a line synchronizing signal at a cycle 1/m times the cycle of the line synchronizing signal generated in the normal mode. For exposure for forming an image for one line extending in the main scanning direction onto a sheet S, the CPU 73 causes the buffer read controller 17 to transmit the same image data signal m times and transmit the image data signal that brings the light-emitting portions 50 into no light emission n-m times, in synchronization with n number of line synchronizing signals generated by the synchronizing signal generation portion 74. Thus, the quantity of light to be emitted to the region corresponding to one pixel on the photoconductive drum 1 can be kept constant between in the normal mode and in the low mode. Therefore, in the low mode, excessive toner can be inhibited from adhering on the photoconductive drum 1.

Note that, in the above description, the rotational rate of the photoconductive drum 1 in the low mode is ⅔ times that in the normal mode, but this is not limiting. That is, the difference in rate between the normal mode and the low mode is not limited to the above, and thus a similar effect can be acquired even with any difference in rate.

In the present embodiment, in order to cover a shortage of light quantity per light-emitting portion 50, multiple exposure is performed with a plurality of light-emitting portions 50 arranged in the Y direction, but this is not limiting. That is, in a case where no multiple exposure with light-emitting portions 50 arranged in the Y direction is required due to a high light quantity per light-emitting portion 50, even the above control with a single row of a plurality of light-emitting portions 50 arranged in the X direction enables acquisition of a similar effect.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2021-100144, filed Jun. 16, 2021, which is hereby incorporated by reference herein in its entirety.

What is claimed is:

1. An image forming apparatus comprising:

a photoconductive drum;

an exposure head including a plurality of light-emitting portions arranged along in a rotational-axis direction of the photoconductive drum, the plurality of light-emitting portions each being configured to emit light, based on an image data signal, for exposure of the photoconductive drum;

a control signal generation portion configured to generate, at a predetermined cycle, a control signal that controls a timing of light emission of each of the plurality of light-emitting portions;

an image data signal transmission portion configured to transmit the image data signal to the exposure head, in synchronization with the control signal, for light emission of each of the plurality of light-emitting portions based on the image data signal; and a controller configured to control the control signal generation portion, the image data signal transmission portion, and a rotational rate of the photoconductive drum, wherein the controller is configured to perform in a first mode in which the photoconductive drum rotates at a first rotational rate and a second mode in which the photoconductive drum rotates at a second rotational rate m/n times the first rotational rate, and lower than the first rotational rate, and in the second mode, for exposure for forming an image for one line onto a sheet, the controller causes the control signal generation portion to generate the control signal at a cycle 1/m times a cycle of the control signal generated in the first mode, and causes the image data signal transmission portion to transmit, to the exposure head, the same image data signal m times and transmit, to the exposure head, the image data signal that brings the plurality of light-emitting portions into no light emission n-m times, in synchronization with n number of the control signals.

2. The image forming apparatus according to claim 1, wherein in the second mode, for the exposure for forming an image for one line onto a sheet, the controller causes the image data signal transmission portion to transmit, to the exposure head, the image data signal that brings the plurality of light-emitting portions into no light emission n-m times after the image data signal transmission portion transmits, to the exposure head, the same image data signal m times, in synchronization with the n number of the control signals.

3. The image forming apparatus according to claim 1, further comprising:

a developing portion configured to develop, as a toner image, an electrostatic latent image formed on a surface of the photoconductive drum by the exposure head;

a transfer portion configured to transfer, to a sheet, the toner image formed on the surface of the photoconductive drum; and a fixing portion configured to fix, to the sheet, the toner image transferred to the sheet, wherein the controller:

controls, based on information regarding a basis weight of a sheet for image forming, a conveyance rate of the sheet that passes through the fixing portion, performs in the first mode in a case where the conveyance rate of the sheet that passes through the fixing portion is a first conveyance rate, and performs in the second mode in a case where the conveyance rate of the sheet that passes through the fixing portion is a second conveyance rate lower than the first conveyance rate.

4. The image forming apparatus according to claim 1, wherein the plurality of light-emitting portions is provided in the exposure head such that a plurality of light-emitting rows is formed of the plurality of light-emitting portions arranged in the rotational-axis direction and the plurality of light-emitting rows is arranged in a direction orthogonal to the rotational-axis direction, and the exposure head performs multiple exposure to a region corresponding to one pixel on a surface of the photoconductive drum with the light-emitting portion in each of the plurality of light-emitting rows.

5. The image forming apparatus according to claim 4, wherein each of the plurality of light-emitting portions includes a first electrode layer including a plurality of electrodes arranged two-dimensionally in the rotational-axis direction and in the direction orthogonal to the rotational-axis direction, the plurality of electrodes being disposed separately from each other on a substrate; a light-emitting layer stacked on the first electrode layer, the light-emitting layer being configured to emit light due to application of voltage; and a second electrode layer disposed opposite the first electrode layer through the light-emitting layer, the second electrode layer allowing light to pass through the second electrode layer.

* * * * *